United States Patent [19]

Rosenberg

[11] Patent Number: 4,659,015

[45] Date of Patent: Apr. 21, 1987

[54] WATER SPRINKLER

[76] Inventor: Peretz Rosenberg, Moshav Beit Shearim, Israel

[21] Appl. No.: 749,448

[22] Filed: Jun. 27, 1985

[30] Foreign Application Priority Data

Jul. 20, 1984 [IL] Israel ..... 72464

[51] Int. Cl.[4] ..... B05B 15/02

[52] U.S. Cl. ..... 239/116; 239/276; 239/590.3; 239/600

[58] Field of Search ..... 239/104, 106, 114, 590, 239/590.3, 590.5, 596, 600, 589, 107, 276, 115–118; 138/139–141

[56] References Cited

U.S. PATENT DOCUMENTS

| | | | |
|---|---|---|---|
| 1,204,309 | 11/1916 | Peterson | 239/590.3 |
| 2,636,779 | 4/1953 | Senior | 239/114 |
| 3,347,267 | 10/1967 | Inmar | 239/104 X |
| 3,968,930 | 7/1976 | Hendrickson | 239/107 |
| 4,256,262 | 3/1981 | Rosenberg et al. | 239/276 |
| 4,356,974 | 11/1982 | Rosenberg et al. | 239/499 X |

*Primary Examiner*—Andres Kashnikow
*Assistant Examiner*—Mary Beth O. Jones
*Attorney, Agent, or Firm*—Benjamin J. Barish

[57] ABSTRACT

A water sprinkler comprises a housing formed with an inlet bore connectable to a source of pressurized water; a tubular connector having one and received within the inlet bore, and its opposite end connectable to the source of pressurized water; and a strainer element supported within the inlet bore by the tubular connector when the latter is received within the inlet bore. The strainer element is formed with a plurality of open notches along its outer edge defining a plurality of passageways of small cross-sectional area blocking the flow of solid particles to the sprinkler, which passageways may be immediately and thoroughly rinsed of the solid particles by merely removing the tubular connector and its strainer element from the inlet bore while the tubular connector is connected to the source of pressurized water.

20 Claims, 5 Drawing Figures

FIG 1
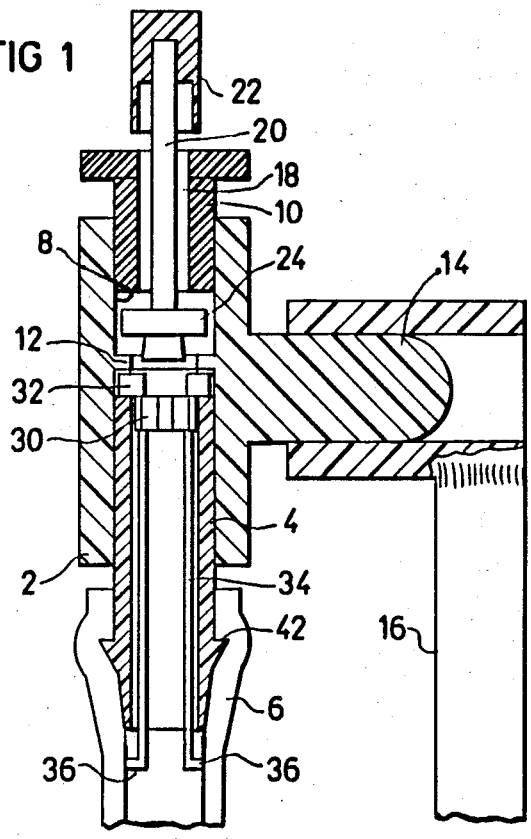
FIG. 2
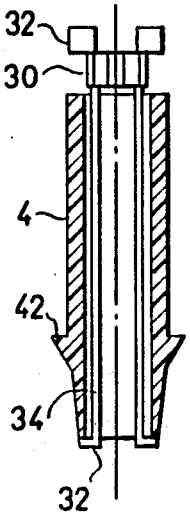
FIG. 3
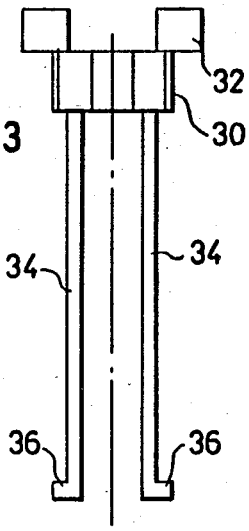
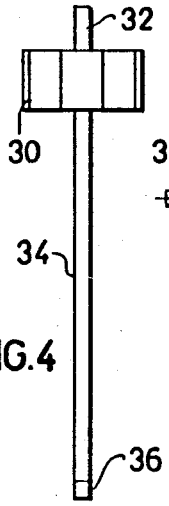
FIG.4
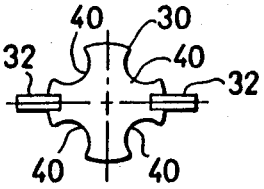
FIG. 5

WATER SPRINKLER

BACKGROUND OF THE INVENTION

The present invention relates to water sprinklers such as are commonly used in water irrigation systems.

One of the important characteristics of the many different types of water sprinklers now in use is their sensitivity to clogging by solid particles in the irrigating water; thus, sprinklers which are easily clogged require high-grade water which is substantially free of foreign particles. Another important characteristic of the known sprinklers is the ease by which they may be cleaned of solid particles since many require the disassembly of the sprinkler or parts thereof in order to rinse out the solid particles.

An object of the present invention is to provide a water sprinkler having advantages in both of the above respects.

SUMMARY OF THE INVENTION

According to a broad aspect of the present invention, there is provided a water sprinkler comprising a housing formed with an inlet bore connectable to a source of pressurized water, a sprinkler nozzle attached to the housing, a tubular connector having one end received within the inlet bore and its opposite end connectable to the source of pressurized water, and a strainer element supported within the inlet bore by the tubular connector when the latter is received within the inlet bore. The strainer element is formed with a plurality of notches along its outer edge defining a plurality of passageways of small cross-sectional area. The strainer element is further formed with retainer means retaining the strainer element attached to the tubular connector but permits the strainer element to move out of the tubular connector when the tubular connector is removed from the housing inlet bore. The arrangement is such that the passageways defined by the edge notches of the strainer element block the flow of solid particles to the sprinkler when the strainer element is within the tubular connector and the tubular connector is within the housing inlet bore during the normal operation of the sprinkler; but when the tubular connector is removed from the housing inlet bore, while the tubular connector is connected to the source of pressurized water, the retainer means permits the strainer element to move out of the tubular connector by the pressurized water so that the pressurized water flushes out the solid particles from the tubular connector and from the notches in the strainer element.

It will thus be seen that solid particles within the irrigating water will be intercepted by the strainer element, and will thereby be prevented from clogging the sprinkler. When the strainer element is overly clogged, which will be apparent by the reduced output of the sprinkler, it is only necessary to pull out the tubular connector from the inlet bore of the sprinkler housing, whereupon the pressurized water will thoroughly rinse out the solid particles from the tubular connection and the notches of the strainer element, and then the tubular connector may be reinserted into the inlet bore, all of which need take but a second or two.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a longitudinal sectional view illustrating one form of water sprinkler constructed in accordance with the present invention;

FIG. 2 is a longitudinal sectional view illustrating only the tubular connector and its strainer element in the sprinkler of FIG. 1; and;

FIGS. 3, 4 and 5 are front, side and top views, respectively, of the strainer element in the sprinkler of FIG. 1.

DESCRIPTION OF A PREFERRED EMBODIMENT

The sprinkler illustrated in FIG. 1 is of a type shown in U.S. Pat. No. 4,356,974, although it will be appreciated that this is shown merely for purposes of example, and that the invention could be advantageously used with respect to many other types of water sprinklers.

The sprinkler illustrated in FIG. 1 comprises a housing 2 formed with an inlet bore at one end for receiving a tubular connector 4 adapted to be connected by a tube 6 to a source of pressurized water. The opposite end of housing 2 is formed with another bore 8 coaxial with the inlet bore, and receiving a sprinkler nozzle 10. Housing 2 further includes an internal annular shoulder 12, and a lateral stem 14 for mounting the sprinkler to a stand 16.

As mentioned earlier, the sprinkler nozzle 10 is of the type of the above-cited Patent Specification. It includes an axial bore 18 receiving a spindle 20 carrying a cup 22 at one end and a cross-bar 24 at the opposite end. Briefly, the water passes through bore 18 in the form of an axial jet, and impinges against the inner face of cup 22, whereupon the cup is raised, until limited by cross-bar 24. The jet produces a water cushion within the cup which reflects back the water to the head of nozzle 10, the latter then deflecting the water laterally outwardly around the sprinkler. This type of sprinkler is now in widespread use, and therefore further details of its construction and operation are not deemed necessary.

In accordance with the present invention, tubular connector 4 received within the inlet bore of housing 2 carries a strainer element 30 formed with a pair of ears 32 at one face receivable between the end of the tubular connector and the inner annular shoulder 12 of the housing. The opposite side of strainer element 30 is formed with a pair of legs 34 extending through the tubular connector 4, which legs terminate in out-turned bends 36 engageable with the opposite end of the tubular connector and thereby retaining the strainer element within the tubular connector.

As shown particularly in FIG. 5, strainer element 30 is of disc-shape, and is formed with a plurality of curved notches 40 (four being shown in FIG. 5) along its outer edge. These curved notches 40 define, with the inner face of tubular connector 4, plurality of passageways of small cross-sectional area which block the flow of solid particles to the sprinkler nozzle 10.

Tube 6 connected to the source of pressurized water is preferably a flexible hose. It is firmly secured to tubular connector 4 by means of an annular flange 42 formed on the outer face of the tubular connector and having a sharpened edge for securely receiving tube 6.

The manner of using the illustrated sprinkler will be apparent from the above description. Thus, the sprinkler is assembled with nozzle 10, its spindle 20 and cup 22, and the nozzle is inserted within bore 8 at one end of the sprinkler housing 2. The strainer element 30 is assembled within tubular connector 4, with ears 32 of the strainer element engaging one end of the tubular connector, and the out-turned ends 36 of the strainer element engageable with or projecting past the opposite end of the tubular connector. Flexible tube 6 is received over the latter end of the tubular connector. The tubular connector is then inserted into the inlet bore of housing 2 to the position illustrated in FIG. 1, wherein ears 32 of the strainer element are firmly pressed between the inner end of the tubular connector and the annular shoulder 12 of the sprinkler housing 2.

Now, when pressurized water is applied via the inlet tubing 6, the water passes through the interior of tubular connector 4, through the passageways definined by the notches 40 of strainer element 30, and then into bore 8 of the housing. From here, the water forms an axial jet flowing through bore 18 to impinge against the inner face of cup 22, thereby raising the cup until stopped by its cross-bar 24. The axial jet of water flowing within cup 22 produces a water cushion which reflects the water back to the upper face of nozzle 10, which latter face then deflects the water laterally outwardly to form an annular spray of water around the sprinkler.

The small cross-sectional area passageways defined by notches 40 together with the inner face of tubular connector 4 block the solid particles in the irrigating water and prevent their passage into bores 8 or 18 where they may tend to clog the sprinkler. Whenever a large quantity of such solid particles has accumulated below strainer element 30, which will be apparent by the reduced output of the sprinkler, the user need merely grasp tube 6 and pull it with tubular connector 4 out of the inlet bore. The strainer element 30 will also be removed with tubular element 4 because of the out-turned ends 36 of the strainer element, and as soon as the strainer element clears the housing inlet bore, the water will push out the strainer element so that it projects past the tubular connector 4. When this occurs the dirt accumulated below the notches 40 of the strainer element will be immediately rinsed out by the pressurized water from the inlet bore 6. The tubular connector 4 may then be reinserted back into the inlet bore of the housing, whereupon the sprinkler is clean and ready for continued operation.

The manipulations to be performed by the user in cleaning the straining element of the accumulated dirt, namely removing tubular connector 4 from the housing inlet bore, and then reinserting it back into the housing, can be performed very conveniently and quickly, needing to take a second or two.

The illustrated sprinkler thus strains out solid particles from the irrigating water before reaching the nozzle 10, thereby imparting to the sprinkler a low sensitivity to clogging; moreover, any dirt particles accumulated within the sprinkler can be easily and quickly removed by merely pulling out tubular element 4 and reinserting it back into the housing, as described above.

It will be appreciated that the invention has been described with respect to one preferred embodiment, but many variations and applications may be made. Thus, the invention can advantageously be used with sprinklers of other types than that illustrated in the drawings. Many other variations, modifications and applications of the invention will be apparent.

What is claimed is:

1. A water sprinkler, comprising:

a housing formed with an inlet bore connectable to a source of pressurized water;

a sprinkler nozzle attached to said housing;

a tubular connector having one end removably received within said inlet bore, and its opposite end connectable to the source of pressurized water;

and a strainer element supported within said tubular connector when the latter is received within said inlet bore;

said strainer element being formed with a plurality of open notches along its outer edge defining a plurality of passageways of small cross-sectional area;

said strainer element being further formed with retainer means which retains the strainer element attached to said tubular connector but permits the strainer element to move out of the tubular connector when the tubular connector is removed from said inlet bore;

whereby the passageways defined by said open notches block the flow of solid particles to the sprinkler when the strainer element is within the tubular connector and the tubular connector is within said housing inlet bore during the normal operation of the water sprinkler, but when the tubular connector is removed from the inlet bore while the tubular connector is connected to said souce of pressurized water, the retainer means permits the strainer element to move out of the tubular connector by the pressurized water so that the pressurized water flushes out the solid particles from the tubular connector and from said notches in the strainer element.

2. The water sprinkler according to claim 1, wherein said retainer means includes legs extending the length of the tubular connector and engageable with its opposite end permitting the strainer element to be moved out of said tubular connector when the latter is removed from the housing inlet bore to facilitate flushing out the blocked solid particles from the tubular connector and strainer element.

3. The sprinkler according to claim 1, wherein said housing is formed with a socket at one end for receiving said sprinkler nozzle, and with said inlet bore at another end for receiving said tubular connector and strainer element.

4. The sprinkler according to claim 3, wherein said housing includes an internal shoulder engageable with said strainer element when inserted into said inlet bore with the tubular connector.

5. The sprinkler according to claim 4, wherein said edge-notched strainer element is a disc received within one end of said tubular connector, and said retainer means includes legs extending the length of the tubular connector and engageable with its opposite end.

6. The sprinkler according to claim 5, wherein said strainer retainer means further includes a pair of fingers receivable between said internal shoulder formed in the housing, and said one end of the tubular connector.

7. The sprinkler according to claim 6, wherein said internal shoulder is of annular configuration.

8. The sprinkler according to claim 3, wherein said socket for receiving said sprinkler nozzle is coaxial with said inlet bore for receiving said tubular connector and strainer element.

9. The sprinkler according to claim 1, wherein said housing includes a stem extending laterally thereof for reception within a socket of a mounting stand.

10. The sprinkler according to claim 1, wherein said tubular connector is formed with an external annular flange having a sharpened edge for receiving a tube connectable to said source of pressurized water.

11. A water sprinkler, comprising:

a housing formed with a socket at one end, an inlet bore at the opposite end connectable to a source of pressurized water, and a stem extending laterally of the housing for reception within a socket of a mounting stand;

a sprinkler nozzle attached to said housing;

a tubular connector having one end removably received within said inlet bore, and its opposite end connectable to the source of pressurized water;

and a strainer element supported within said tubular connector when the latter is received within said inlet bore;

said strainer element being formed with a plurality of open notches along its outer edge defining a plurality of passageways of small cross-sectional area;

said strainer element being further formed with retainer means which retains the strainer element attached to said tubular connector but permits the strainer element to move out of the tubular connector when the tubular connector is removed from said inlet bore;

whereby the passageways defined by said open notches block the flow of solid particles to the sprinkler when the strainer element is within the tubular connector and the tubular connector is within said housing inlet bore during the normal operation of the water sprinkler, but when the tubular connector is removed from the inlet bore while the tubular connector is connected to said souce of pressurized water, the retainer means permits the strainer element to move out of the tubular connector by the pressurized water so that the pressurized water flushes out the solid particles from the tubular connector and from said notches in the strainer element.

12. The water sprinkler according to claim 11, wherein said retainer means includes legs extending the length of the tubular connector and engageable with its opposite end permitting the strainer element to be moved out of said tubular connector when the latter is removed from the housing inlet bore to facilitate flushing out the blocked solid particles from the tubular connector and strainer element.

13. The sprinkler according to claim 11, wherein said housing is formed with a socket at one end for receiving said sprinkler nozzle, and with said inlet bore at another end for receiving said tubular connector and strainer element.

14. The sprinkler according to claim 13, wherein said housing includes an internal shoulder engageable with said strainer element when inserted into said inlet bore with the tubular connector.

15. The sprinkler according to claim 14, wherein said edge-notched strainer element is a disc received received within one end of said tubular connector, and said retainer means includes legs extending the length of the tubular connector and engageable with its opposite end.

16. The sprinkler according to claim 15, wherein said strainer element retainer means further includes a pair of fingers receivable between said internal shoulder formed in the housing, and said one end of the tubular connector.

17. The sprinkler according to claim 15, wherein said internal shoulder is of annular configuration.

18. The sprinkler according to claim 15, wherein said socket for receiving said sprinkler nozzle is coaxial with said inlet bore for receiving said tubular connector and strainer element.

19. A water sprinkler, comprising:

a housing formed with an inlet bore connectable to a source of pressurized water;

a sprinkler nozzle attached to said housing;

a tubular connector having one end received within said inlet bore, and its opposite end connectable to the source of pressurized water;

and a strainer element removably supported within said inlet bore by said tubular connector when the latter is received within said inlet bore;

said strainer element being formed with a plurality of open notches along its outer edge defining a plurality of passageways of small cross-sectional area blocking the flow of solid particles to the sprinkler, which passageways may be immediately and thoroughly rinsed of said solid particles by merely removing the tubular connector and its strainer element from the inlet bore while the tubular connected is connected to said source of pressurized water;

said strainer element being received within said tubular connector during the normal operation of the sprinkler for defining therewith said plurality of passageways of small cross-sectional area blocking the solid particles in the water, said strainer element including retainer legs extending the length of the tubular connector and engageable with its opposite end permitting the strainer element to be moved out of said tubular connector when the latter is removed from the housing inlet bore to facilitate flushing out the blocked solid particles from the tubular connector and strainer element.

20. The sprinkler according to claim 19, wherein said housing is formed with a socket at one end for receiving said sprinkler nozzle, and with said inlet bore at another end for receiving said tubular connector and strainer element.

* * * * *